US005901970A

United States Patent [19]

Henshaw

[11] Patent Number: 5,901,970

[45] Date of Patent: May 11, 1999

[54] METAL WHEELS FOR ROLLER ICE SKATES

[76] Inventor: Richard C. Henshaw, 1340 S. Atlantic Ave., Cocoa Beach, Fla. 32931-2372

[21] Appl. No.: 08/603,034

[22] Filed: Feb. 16, 1996

Related U.S. Application Data

[63] Continuation-in-part of application No. 08/456,769, Jun. 1, 1995, abandoned.

[51] Int. Cl.[6] ..... A63C 17/00

[52] U.S. Cl. ..... 280/11.19; 280/841; 280/11.22; 301/5.3

[58] Field of Search ..... 280/84.1, 7.13, 280/11.19, 11.22, 11.27; 301/5.3; 36/115

[56] References Cited

U.S. PATENT DOCUMENTS

| | | | |
|---|---|---|---|
| 284,009 | 8/1883 | Henry | 301/5.3 |
| 480,610 | 8/1892 | Nielson | 280/11.22 |
| 657,790 | 9/1900 | Ross | 301/5.3 |
| 1,489,197 | 4/1924 | Daverkosen et al. | 280/11.19 |
| 2,048,916 | 7/1936 | Bentzlin | 280/11.22 |
| 3,537,716 | 11/1970 | Norgiel | 36/115 |
| 3,552,746 | 1/1971 | Nagin | 272/3 |
| 3,689,091 | 9/1972 | Nagin | 280/11.12 |
| 3,807,062 | 4/1974 | Spier | 36/2.5 AL |
| 4,043,656 | 8/1977 | Mogannam | 280/7.13 |
| 4,108,450 | 8/1978 | Cote | 280/11.22 |
| 4,323,259 | 4/1982 | Boudreau | 280/7.13 |
| 4,492,385 | 1/1985 | Olson | 280/7.13 |
| 4,699,390 | 10/1987 | Cote | 280/11.23 |
| 4,709,937 | 12/1987 | Lin et al. | 280/11.2 |
| 5,129,663 | 7/1992 | Soo | 280/7.14 |
| 5,193,827 | 3/1993 | Olson | 280/7.13 |
| 5,259,632 | 11/1993 | Mahoney | 301/5.3 |
| 5,320,366 | 6/1994 | Shing | 280/7.14 |
| 5,340,132 | 8/1994 | Malewicz | 280/11.22 |

FOREIGN PATENT DOCUMENTS

| | | | |
|---|---|---|---|
| 392450 | 3/1924 | Germany | 280/841 |
| 682058 | 10/1939 | Germany | 280/841 |
| 2328256 | 1/1975 | Germany | 36/115 |
| 374420 | 8/1939 | Italy | 280/11.22 |
| 357010 | 10/1961 | Switzerland | 301/5.3 |
| 29137 | 12/1909 | United Kingdom | 280/11.22 |
| 571048 | 8/1945 | United Kingdom | 280/11.22 |
| 1120895 | 6/1966 | United Kingdom | 280/11.22 |

*Primary Examiner*—Brian L. Johnson
*Assistant Examiner*—Min Yu
*Attorney, Agent, or Firm*—Brian S. Steinberger; Law Offices of Brian S. Steinberger

[57] ABSTRACT

Novel tempered rust resistant steel wheels for installation on conventional in-line four wheel roller skates, parallel four wheel roller skates, and, in-line five wheel roller skates that convert traditional ground roller skates into ice skates. The novel wheels can have different diameters, thicknesses and varying concave edges. The diameters and sizes of the tempered rust resistant steel wheels must be the same as the roller skates' composition or rubber type wheels, except for the thickness of the wheels can be ¼ inch, 3/16 inch for in-line skates and ¼ to ½ inches for a parallel wheel roller skate. The heights of the sharpened concave edges for the steel wheels can be approximately 30/1000" to approximately 40/1000". Optional scraper bars can be used. The wheels can be used for making ice skates used for figure, dance, pair, freestyle, and recreational skating. An mathematical algorithm and equations are disclosed that determines the desired convex edge dimensions on a cutting bit that conforms to a concave edge on the wheel using a selected wheel thickness and concave curvature edge heights.

7 Claims, 5 Drawing Sheets

100
102
104
105
106
107
108
109
110
111
112
120
160
162
164
165
166
167
169
199
$X_1$
$d_1$
$h_1$
$T_1$
$S_1$

260
$d_2$
266
267
265
264
$h_2$
$t_2$
262
$X_2$ 200
202
206
208
210
211
260
269
$S_2$
267

Fig. 3A
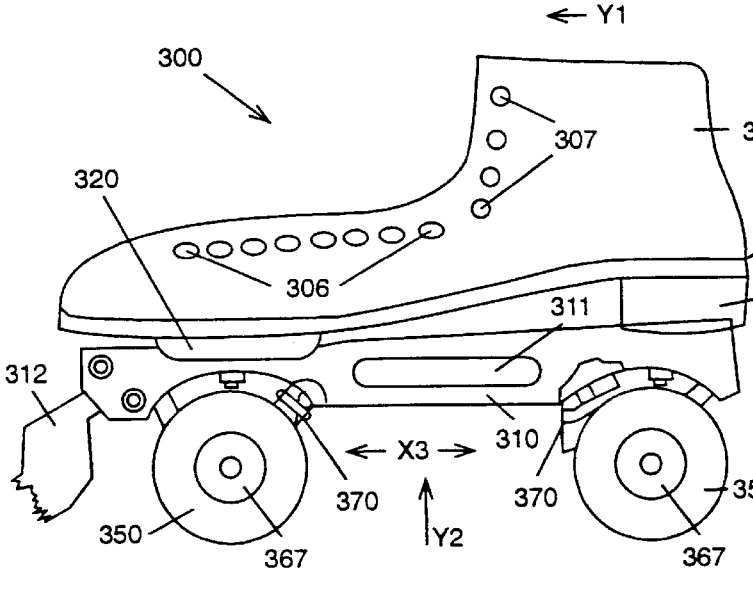
Fig. 3B
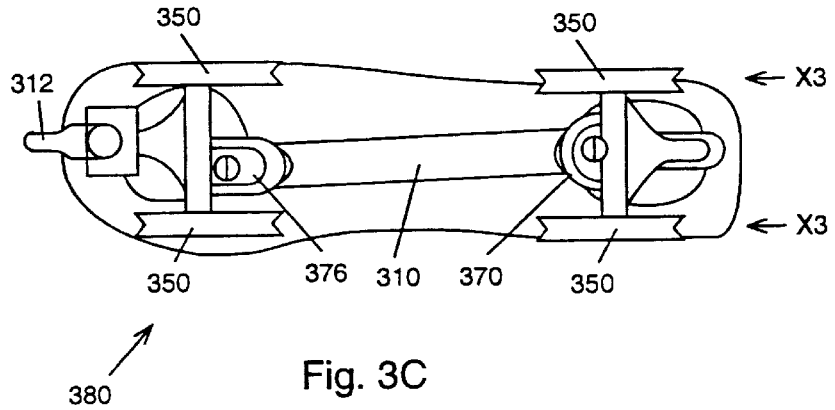
Fig. 3C

METAL WHEELS FOR ROLLER ICE SKATES

This invention relates to ice skate wheels that can be substituted for both existing wheels on in-line roller skates and on parallel wheel roller skates. This Application is a Continuation-In-Part (CIP) of Ser. No. 08/456,769 filed Jun. 1, 1995, now abandoned and entitled: In-Line Roller Ice Skates by the same inventor, which is incorporated by reference.

BACKGROUND AND PRIOR ART

Conventional ice skates have been restricted to using various types of metal blades such as Sheffield steel blades. The different types of ice skates such as hockey, figure and speed require specific shapes and dimensions for the blades.

In-line roller skates such as Roller Blades® have been developed in the past several years that allow the roller skater greater dexterity, balance and speed than traditional parallel wheel roller skates. However, the composition or rubber type wheels on both parallel wheel roller skates and in-line wheel roller skates as such are not adaptable for use on frozen ice surfaces. In-line metal wheels have been patented, but they are not applicable for hockey, figure and speed ice skate use. See, for example, U.S. Pat. No. 3,552,746 to Nagin; U.S. Pat. No. 4,699,390 to Cote; and U.S. Pat. No. 3,689,091 to Nagin.

Prior art convertible skates have been patented to allow a skater to remove wheels and substitute blades and vice-versa depending upon use. However, these prior art devices specifically restrict the wheels for use on synthetic plastic/cement surfaces while the blades are to be used on frozen ice surfaces. See, for example, U.S. Pat. No. 4,323,259 to Bourdreau; U.S. Pat. No. 4,492,385 to Olsen; U.S. Pat. No. 4,709,937 to Linn, et al.; U.S. Pat. No. 5,129,663 to Soo; U.S. Pat. No. 5,193,827 to Olsen; and U.S. Pat. No. 5,320,366 to Shing.

None of the prior art adapts roller skate wheels for use on frozen ice surfaces.

SUMMARY OF THE INVENTION

The first objective of the present invention is to provide tempered rust resistant steel wheels for commercially available roller skates, wherein each wheel has concave sharpened edges for use on frozen ice surfaces.

The embodiments of tempered rust resistant steel wheels for frozen ice surfaces are disclosed herein. The diameters and sizes of the wheels should be the same as the composition or rubber type wheels used on commercially available roller skates for which the tempered rust resistant steel wheels shall replace. The bearings can be sealed to prevent rusting from dampness on the ice. the same number of bearings and spacers (if required) in the commercial roller skates' composition on rubber type wheels shall be used. Each novel wheel includes rounded outer concave edges.

For a four wheel in-line roller ice skate the tempered rust resistant steel wheels can have diameters of approximately 3 inches, thicknesses of approximately ¼ inch and sharpened concave edge heights of approximately $^{30}/_{1000}$ to $^{40}/_{1000}$ of an inch.

For a five wheel in-line roller ice skate the tempered rust resistant steel wheels can have diameters of approximately 2.83 to approximately 2.99 inches, thicknesses of approximately $^{3}/_{16}$ inch and sharpened concave edges heights of approximately $^{30}/_{1000}$ to $^{40}/_{1000}$ of an inch.

For a four wheel parallel roller ice skate each of the tempered rust resistant wheels can have diameters of approximately 2 inches, thicknesses of approximately ¼ to approximately ½ inches and have sharpened concave edge heights of approximately $^{30}/_{1000}$ to $^{40}/_{1000}$ of an inch.

For commercial applications the novel four wheel in-line roller skate model can be available with composition or rubber type wheels, or, with the tempered rust resistant steel wheels, or, with both, as the skater could switch from either depending upon the use in a roller rink or on a sidewalk, or in an ice rink.

Attachable tempered rust resistant steel toe picks for a frozen ice surface, or, attachable composition or rubber type stopper(s) for a roller rink or sidewalks can be provided which the skater could attach as appropriate.

The in-line four tempered rust resistant steel wheel ice skate model can be available for free style, ice dancing, pair or figure skating with the steel toe picks attached, or hockey without the steel toe picks or stopper(s) attached, or, for recreational skating with or without the steel toe picks attached.

The in-line five tempered rust resistant steel wheel ice skate model can be available for recreational or speed skating. the composition or rubber type five wheel model has not employed stopper(s) and the tempered rust resistant five wheel steel ice skate model would not utilize steel toe picks.

Eight tempered rust resistant steel wheels, with or without attachable steel toe picks, can be made commercially available for four parallel wheel roller skates so that the ice skater could attach the steel wheels and the steel toe picks if desired to her/his roller skates so that the ice skater could participate in freestyle, figure, dance, pair, or recreational ice skating.

Further objects and advantages of this invention will be apparent from the following detailed description of presently preferred embodiments which are illustrated schematically in the accompanying drawings.

BRIEF DESCRIPTION OF THE DRAWINGS

FIG. 3A is a side view of a third preferred embodiment of using the novel roller ice-skate wheels.

FIG. 3B is a rear view along arrow Y1 of the third preferred embodiment of FIG. 3A.

FIG. 3C is a bottom view along arrow Y2 of the third preferred embodiment of FIG. 3A.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

The subject inventor tested novel tempered rust resistant steel metal wheels with various dimensions of diameters, thicknesses, and concave edge heights at Clarence L. Munn Ice Arena at Michigan State University in July-August 1995, Austin Ice Rink, Austin, Tex. in September, 1995 and at Rock On Ice Arena, Orlando, Fla. in October-November, 1995, the results of which are incorporated in the following three embodiments.

FIRST PREFERRED EMBODIMENT

Figures 1A, 1B:
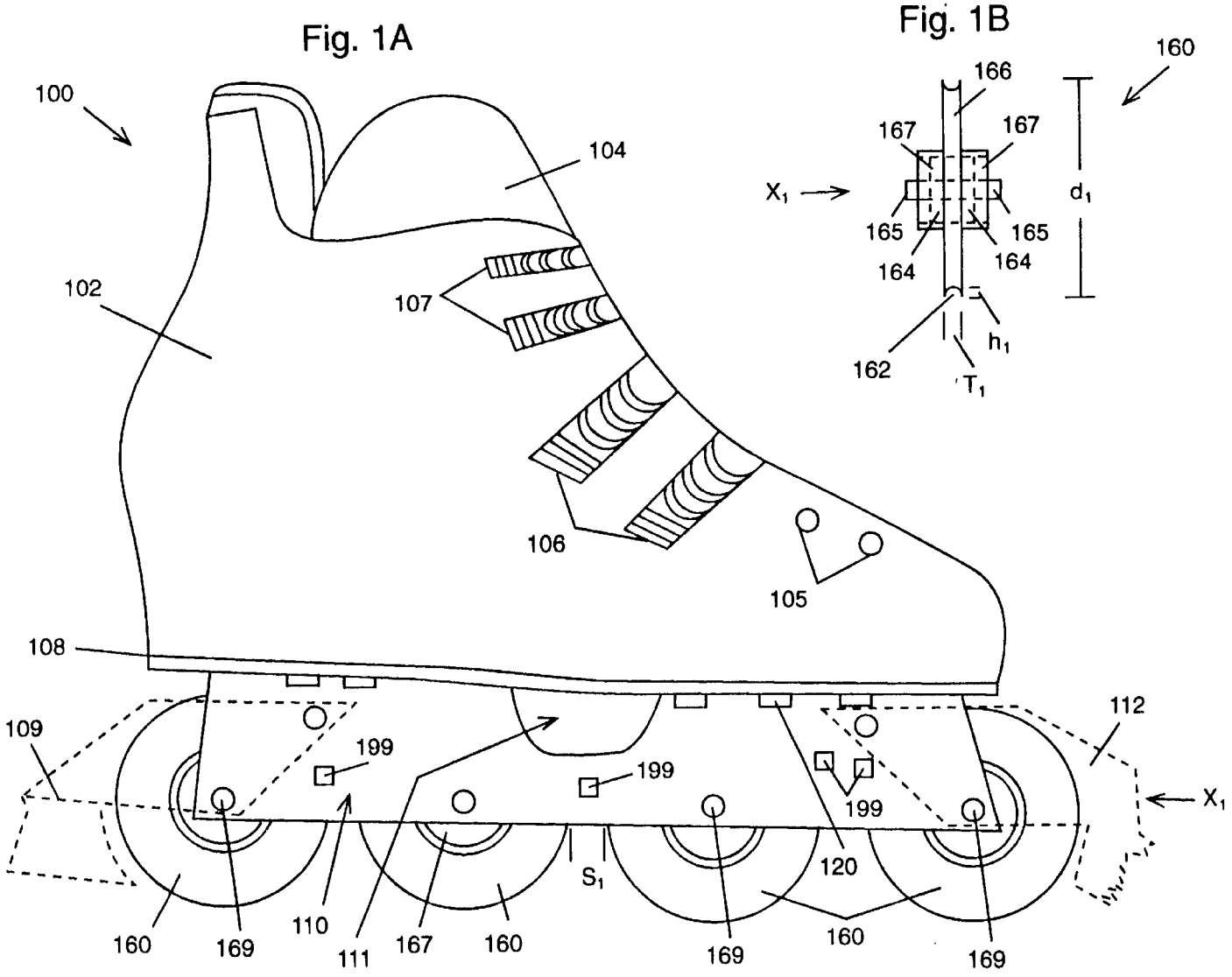
FIG. 1A is a side view of a first preferred embodiment of using the novel roller ice skate wheels.
FIG. 1B is a front view along arrow X1 of the tempered rust resistant steel wheels used in the first preferred embodiment of FIG. 1A.

FIG. 1A is a side view of a four wheel in-line roller ice skate embodiment 100 which includes leather or plastic boot 102, lace holes, straps 105, 106, 107 (which also could be buckles or a combination of laces and buckles, or a combination of lace holes and prongs at the top) for securing boot 100 about the skater's foot, and a tongue 104. An in-line roller skate that can be used with the novel wheels can be one manufactured by USA Model No. Riedel 601 Extreme In-Line Roller Skate. Frame 110, can be formed from rust resistant steel, or aluminum. Alternatively, frame 110 can be formed from fiberglass reinforced nylon, and the like. Frame 110 is joined to the underside of sole 108 by fasteners 120 such as small screws, rivets and the like. An oval hole 111 can pass from the right side to the left side of frame 110. Frame 110 has a like side on the opposite side of skate 100. Frame 110 can be adjustable and detachable from the sole 108. The novel tempered rust resistant steel wheels 160 are detachably mounted by fasteners 169 such as screws, bolts and the like, along frame 110. The spacing, S1, between wheels 160 can be approximately ¾". The size of the tempered rust resistant steel wheels 160 can vary depending upon the size of the composition and rubber type wheels that are used on in-line roller skates. The detachable stopper 109 can be detached from the in-line roller skates when they were converted to in-line ice skates. Likewise, the attachable steel toe picks 112 can be attached when the roller skates are converted to ice skates. Components 199 refers to optional scraper bars, such as but not limited to rust resistant metal bars, plastic bars and the like, that extend from one side of the skate to the other for constantly wiping off any ice buildup while wheels 160 are rotating.

FIG. 1B is a front view along arrow X1 of the wheels 160 used in the embodiment of FIG. 1A. Each of the wheels 166 can be formed from tempered rust resistant steel with individual diameter, d, the same size as the wheels from the roller skate which is being used and can have a diameter of approximately 3 inches, and a thickness, T1 of approximately ¼ inch at the outer edge of the circumference. Each steel wheel 160 has a rounded concave edge portion 162 with concave edges having sharp points of height, H1, of approximately 30/1000 to 40/1000 of an inch. The sharpened concave edges can be sharpened as needed. Each steel wheel 160 has an internal shaft area that includes two sealed ball bearings 167 with a spacer 164 in between and two outer spaces 165, each of which enter into the ends of spacer 164 and into the frame 110. The screws 169 pass through the two outer spacers 165 and through the inner spacer 164.

SECOND PREFERRED EMBODIMENT

Figures 2A, 2B:
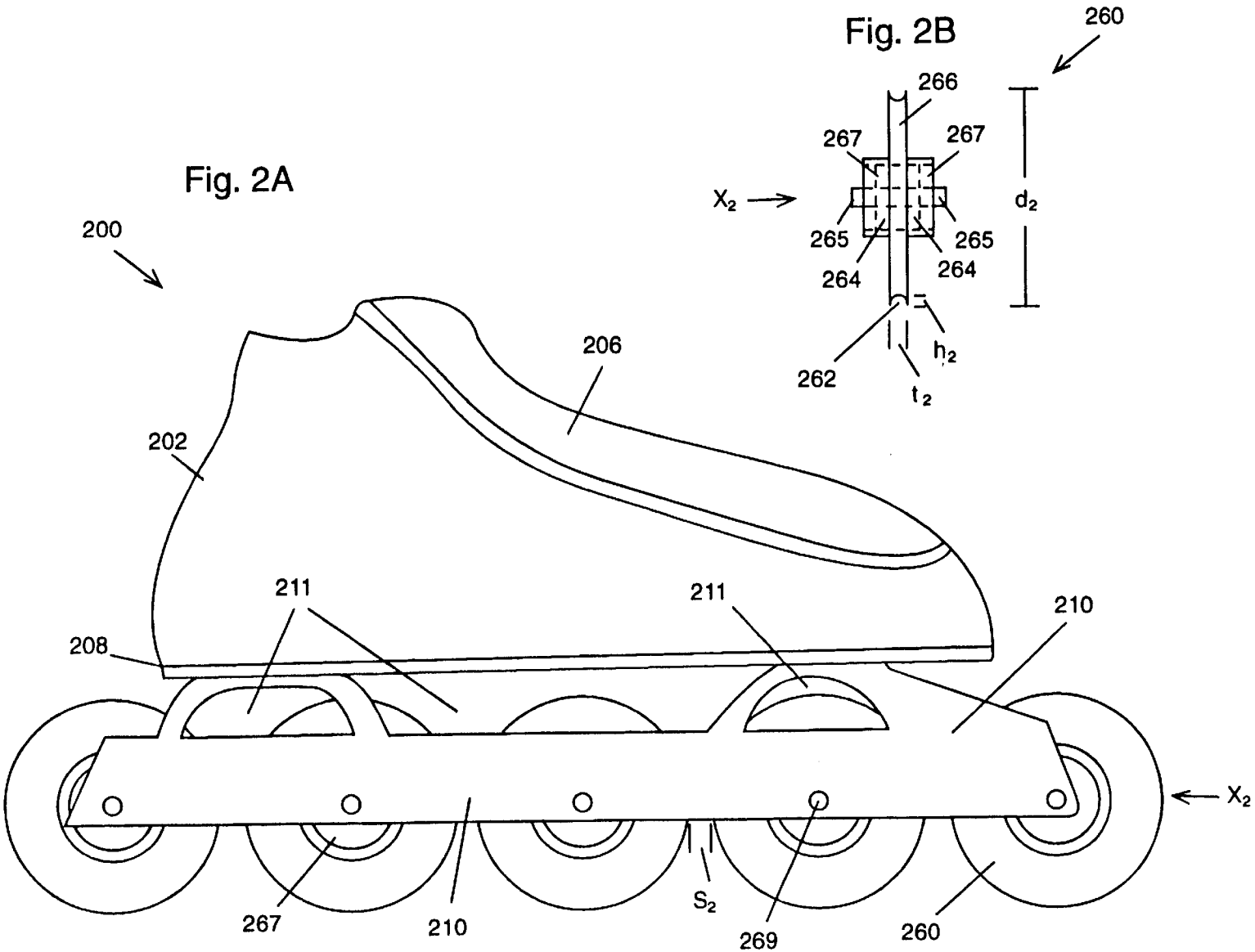
FIG. 2A is a side view of a second preferred embodiment of using the novel roller ice skate wheels.
FIG. 2B is a front view along arrow X2 of the tempered rust resistant steel wheels used in the second preferred embodiment of FIG. 2A.

FIG. 2A is a side view of a second preferred embodiment 200 of using the novel roller ice skate wheels 260 in a five wheel in-line roller skate. FIG. 2B is a front view along arrow X2 of the tempered rust resistant steel wheels 260 used in the second preferred embodiment 200 of FIG. 2A. Referring to FIGS. 2A–2B, embodiment 200 includes leather or plastic boot 202, shoe tie fasteners 206 such as Velcro® overlay or the shoe tie fasteners 105–107 described above. An in-line roller skate 202 that can be used with the novel wheels 260 can be one manufactured by U.S.A. Model No. Riedel 501 Composite In-Line Roller Skate. Frame 210, can be formed from rust resistant steel, or aluminum. Alternatively, frame 210 can be formed from fiberglass reinforced nylon, and the like. Frame 210 is joined to the underside of sole 208 by an the fasteners 120 previously mentioned. Openings 211 can pass from the right side to the left side of frame 210. Frame 210 has a like side on the opposite side of skate 200. The novel tempered rust resistant steel wheels 260 are detachably mounted by fasteners 269 such as screws, bolts and the like, along frame 210. The spacing, S2, between wheels 260 can be up to approximately ¾ inch. The size of the tempered rust resistant steel wheels 260 can vary depending upon the size of the composition and rubber type wheels that are used on in-line roller skates.

FIG. 2B is a front view along arrow X2 of the wheels 260 used in the embodiment of FIG. 1A. Each of the wheels 266 can be formed from tempered rust resistant steel with individual diameter, d2, the same size as the wheels from the roller skate which is being used and can have a diameter of approximately 2.83 to approximately 2.99 inches, and a thickness, T2 of approximately 3/16 inch at the outer edge of the circumference. Each steel wheel 160 has a concave edge portion 162 with concave edges having sharp points of height, H2, of approximately 30/1000 to 40/1000 of an inch. The sharpened concave edges can be sharpened as needed. Each steel wheel 260 has an internal shaft area that includes two sealed ball bearings 267 with a spacer 264 in between and two outer spaces 265, each of which enter into the ends of spacer 264 and into the frame 210. The screws 269 pass through the two outer spacers 265 and through the inner spacer 264.

THIRD PREFERRED EMBODIMENT

FIG. 3A is a side view of a third preferred embodiment 300 of using the novel roller ice-skate wheels 350. FIG. 3B is a rear view along arrow Y1 of the third preferred embodiment 300 of FIG. 3A. FIG. 3C is a bottom view along arrow Y2 of the third preferred embodiment 300 of FIG. 3A. Embodiment 300 includes a leather or plastic boot 302, tie fasteners 306–307 which correspond to like tie fasteners 105–107 described in reference to FIGS. 1A–1B. An in-line roller skate 302 that can be used with the novel wheels can be a manufactured Model Laser Brown parallel wheel roller skate. Frame 310, can be formed from rust resistant steel, or aluminum. Alternatively, frame 310 can be formed from fiberglass reinforced nylon, and the like. Frame 310 is joined to the underside of sole 308 by sole portions 320 and heel 307 using fasteners 120 described above. An oval hole 311 can pass from the right side to the left side of frame 310. Frame 310 has a like side on the opposite side of skate 300.

Referring to FIGS. 3A–3C, the novel tempered rust resistant steel wheels 360 are detachably mounted by axle fasteners 369 such as screws, bolts and the like through an axle mounting 370 on the underside of frame 310. The size of the tempered rust resistant steel wheels 350 can vary depending upon the size of the composition and rubber type wheels that are used on parallel wheel roller skates. Attachable steel toe picks 312 can be attached when the parallel wheel roller skates are converted to ice skates. Each of the wheels 350 can be formed from tempered rust resistant steel with individual diameter, d3, the same size as the wheels from the roller skate which is being used and can have a diameter of approximately 2 inches, and a thickness, T3 of approximately ¼ to ½ inches at the outer edge of the circumference. Each steel wheel 350 has a concave edge portion 362 with concave edges having sharp points of height, h3, of approximately $^{30}/_{1000}$ to $^{40}/_{1000}$ of an inch. The sharpened concave edges can be sharpened as needed. Each steel wheel 350 can also have internal ball bearings and spacers such as those described in the previous embodiments.

Figure 4B:
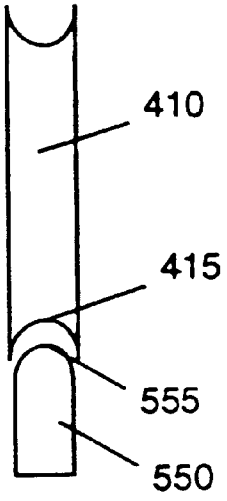
FIG. 4B is a top partial view of the bit cutter and wheel of FIG. 4A along arrow M.
Figure 4A:
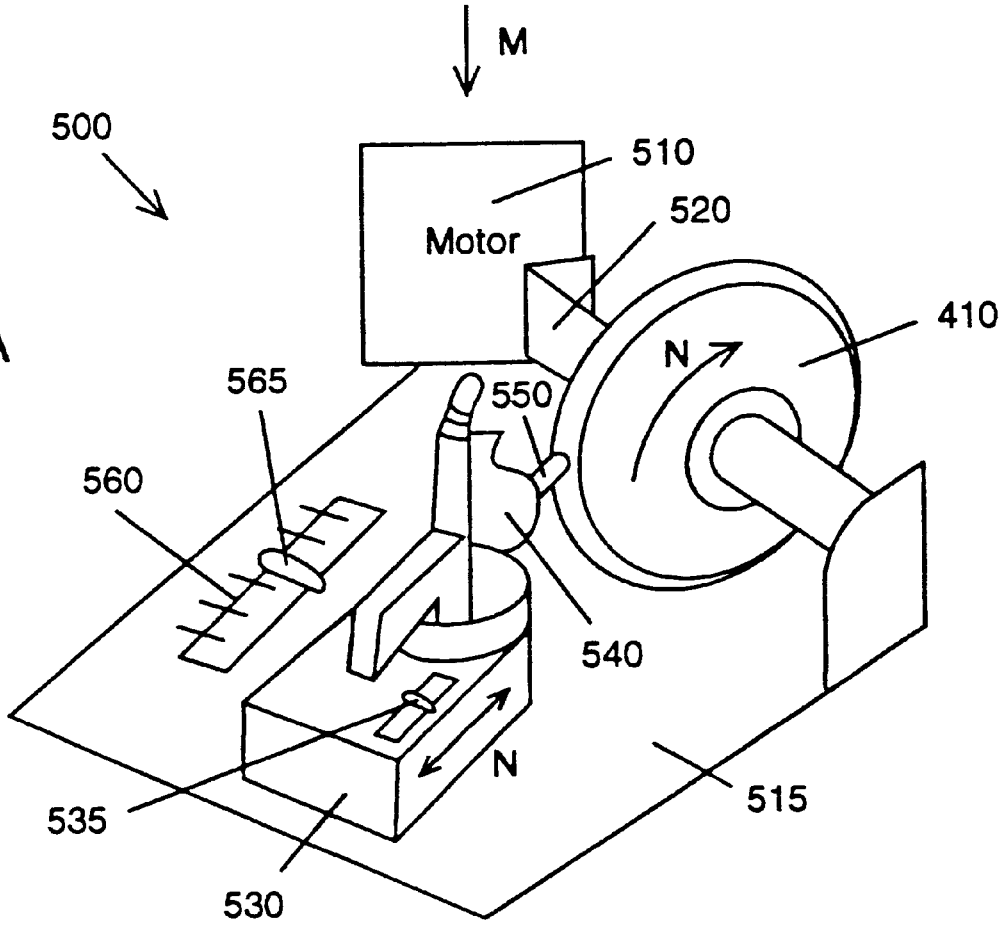
FIG. 4A is a perspective view of lathe setup for forming selected concave curvature edges on the novel wheels.

FIG. 4A is a perspective view of lathe/milling setup 500 for forming selected concave curvature edges 415 on the novel wheels 410, the latter of which corresponds to the novel wheels 160, 260 and 350 described previously. FIG. 4B is a top partial view of the bit cutter 550 and wheel 410 of FIG. 4A along arrow M. Referring to FIGS. 4A–4B, lathe setup includes an 120 Volt electric motor 510 for turning a spindle 520 that holds a wheel 410 to be worked on all mounted to a support platform 515. A tool holder 540 holds a bit cutter 550 for forming concave edge cuts 415 onto the side edges of a wheel 410. A vice feedscrew 535 allows for holder mount 530 to be movable in the directions of arrow N on support platform 515 wherein the location of mount 530 can be measured by pointer 565 along position measurer 560. The lathe/milling setup 500 with the exception of wheel 410, and bit cutter 550 can be lathe/milling machine manufactured by Claussing Division Lathe/Milling machines of the Atlas Press Company or an equivalent. The cutting bit 550 can be manufactured tool steel, carbide steel, diamond tip and the like.

Figure 4C:
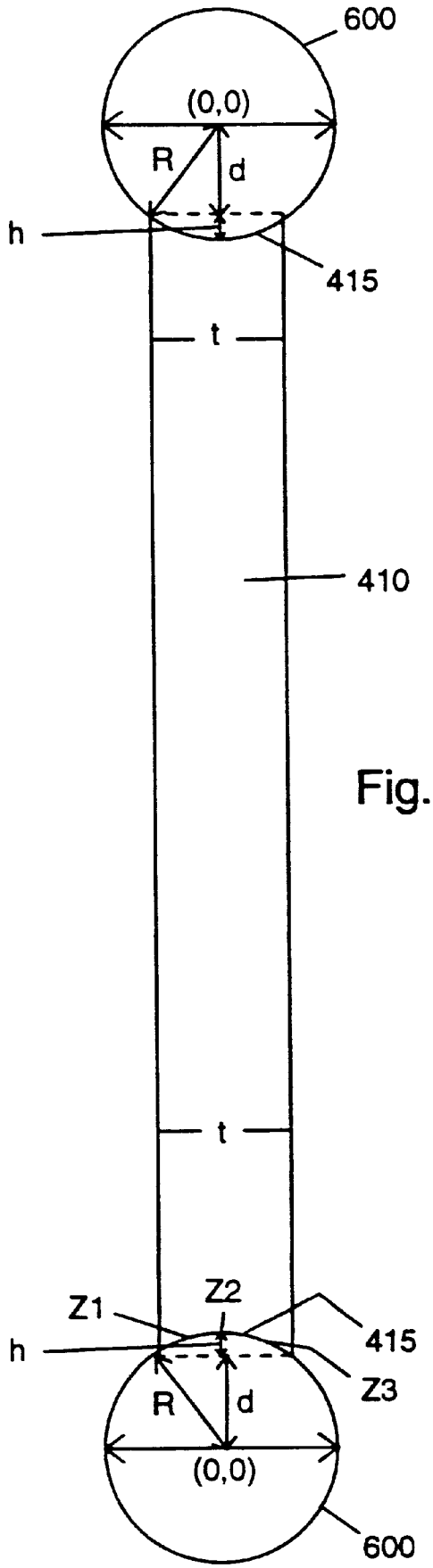
FIG. 4C is an enlarged view of the bit cutter corresponding to a circle equivalent of FIG. 4B.

FIG. 4C is an enlarged view of the bit cutter edge 555 of FIG. 4B corresponding to a circle equivalent 600 of FIG. 4B. The curved edge dimensions of the cutting bit 555 of FIG. 4B can be determined by calculating the circle dimensions of circle 600 shown in FIG. 4C. The curvature of concave edge 415 can be determined by calculating specific points (such as Z1, Z2, and Z3) on the concave edge itself. First, a user selects a wheel thickness, t, and a concave edge height, h, for each wheel 410 of FIG. 4C, and then calculates these specific points. Note for example, radius, R, of the circle, 600 corresponds to the lengths, d plus h, thus: R=d+h. Further note that height, h corresponds to half the thickness, t, thus: h=t/2. The calculations can be as follows:

$$R^2=d^2+(t/2)^2$$

(R=radius; runs from the origin, x=o, y=o, to external points on the circle, i.e. Z1, Z2, Z3)

$$R^2=(d+h)^2=d^2+(t/2)^2$$

$$d^2+2dh+h^2=d^2+(t/2)^2$$

$$2dh+h^2=(t/2)^2$$

$$h(2d+h)=(t/2)^2$$

A user can select a concave edge height, h=$^{40''}/_{1,000}$=$^{4''}/_{100}$=0.04", and a wheel thickness, t=¼". From the above equations:

$^{40''}/_{1,000}(2d''+^{40}/_{1000})=(1''/(4\times2))^2=1/64$ 0.04((2d+0.04)=1/64

0.08d+0.016=0.0015625

0.08d=0.015625−0.0016=0.014025, thus length, d corresponds to:

d=0.014025/0.08=0.1753125, and radius, R corresponds to:

R=d+h=0.1753125+0.04=0.2153125,

Therefore:

R=0.2153125"

d=0.1753125"

when wheel thickness, t=¼", and length, h=$^{40''}/_{1,000}$=$^{1''}/_{25}$=0.04"

$X^2+y^2=R^2$ is the equation of a curve (circle centered at origin, x=o, y=o)

$y^2=R^2-x^2$, a user can now select an x component in order to determine the corresponding y component on the concave edge 415.

Using x=1/16:

$y^2=(0.2153125)^2-(\pm1/16)^2$; i.e. x=±1/16"

$y^2=0.046359472-0.00390625=0.042453222$ y=square root of0.04245322=0.206041796 so, for example, we have 5 points on the concave edges at:

x=±h/2=±⅛, y=±d=±0.1753125 at x=o, y=±(d+h)=±R=I(0.1753125+0.04)=±0.2153125 at x=±1/16", y=±0.206041796.

The above calculations can be used to determine the concave edge curve points that can then be used to determine the corresponding convex edge curvature dimensions of the bit cutter 555 of FIG. 4B used with tool holder 540 of FIG. 4A.

Although the preferred embodiments describe using rust resistant metal for the wheels, each wheel can be coated with protective materials such as but not limited to Kynar® powder coat paint, Teflon® powder coat paint, chrome plating and the like.

Although the internal rounded concave edges on each of the wheels has been described cutting out the concave edges tools with cutting bits on lathe machines, the novel cutting technique can be practiced automatically such as but not limited to using an IBM compatible computer, and robotics and the like.

Although scraper bars are only shown in the the first preferred embodiment, the other embodiments can equally utilize installed scraper bars in a like manner.

Although the invention describes in-line skates having 4–5 wheels and 4 wheel parallel skates, the invention is applicable to in-line skates having less than four wheels and more than five wheels, and, parallel type skates of less than four wheels and more than four wheels.

Furthermore, the invention can be used with a skate having an odd wheel which could be positioned in the middle of the parallel wheel skate fame. This invention encompasses tempered rust resistant steel wheels and including but not limited to galvanized steel, stainless steel and chrome coated steel which can be used to replace composition and rubber type wheels used on existing roller skates.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. A rust resistant steel wheel that can be substituted for rubber and composited wheels for attachment to existing roller skates, the wheel comprising:

a main disc portion formed from rust resistant steel; and a sharpened concave edge running along both exterior sides of an outer circumference of the disc portion, wherein the wheel can be substituted for rubber and composite wheels used on an existing roller skate, each sharpened edge having parallel concave edges has a height of approximately 30/1000 to 40/1000 of an inch, and a diameter of approximately 2 to approximately 3 inches.

2. The rust resistant steel wheel of claim 1, wherein the existing roller skate includes:

an in-line roller skate.

3. The rust resistant steel wheel of claim 1 in combination with ice skates, further including:

a scraper bar mounted adjacent to each wheel for constantly wiping off ice and slush buildup while each wheel is rotating during use.

4. A rust resistant steel wheel that can be substituted for rubber and composited wheels for attachment to existing roller skates, the wheel comprising:

a main disc portion formed from rust resistant steel;

a sharpened concave edge running along both exterior sides of an outer circumference of the disc portion; and a diameter of approximately 3 inches, a thicknesses of approximately ¼ inch, and sharpened concave edge heights of approximately 30/1000 to 40/1000 of an inch, wherein the wheel can be substituted for rubber and composite wheels used on an existing roller skate.

5. The rust resistant steel wheel of claim 4, the existing roller skate including:

a four wheel in-line roller ice skate.

6. A rust resistant steel wheel that can be substituted for rubber and composited wheels for attachment to existing roller skates, the wheel comprising:

a main disc portion formed from rust resistant steel;

a sharpened concave edge running along both exterior sides of an outer circumference of the disc portion; and a diameter of approximately 2 and ½ inches, a thickness of approximately 3/16 inch and sharpened concave edge heights of approximately 30/1000 to 40/1000 of an inch, wherein the wheel can be substituted for rubber and composite wheels used on an existing roller skate.

7. The rust resistant steel wheel of claim 6, the existing roller skate including:

a five wheel in-line roller ice skate.

* * * * *